United States Patent [19]

Meistrick et al.

[11] Patent Number: 4,706,625

[45] Date of Patent: Nov. 17, 1987

[54] ENGINE RETARDER WITH RESET AUTO-LASH MECHANISM

[75] Inventors: Zdenek S. Meistrick, Bloomfield; Robert B. Price, Manchester, both of Conn.

[73] Assignee: The Jacobs Manufacturing Company, Bloomfield, Conn.

[21] Appl. No.: 897,037

[22] Filed: Aug. 15, 1986

[51] Int. Cl.[4] ..... F02D 13/04

[52] U.S. Cl. ..... 123/321; 123/90.46

[58] Field of Search ..... 123/320–322, 123/90.12, 90.15, 90.16, 90.45, 90.46, 198 F

[56] References Cited

U.S. PATENT DOCUMENTS

| | | | |
|---|---|---|---|
| 3,220,392 | 11/1965 | Cummins | 123/97 |
| 3,405,699 | 10/1968 | Laas | 123/97 |
| 4,150,640 | 4/1979 | Egan | 123/97 B |
| 4,271,796 | 6/1981 | Sickler et al. | 123/321 |
| 4,384,558 | 5/1983 | Johnson | 123/321 |
| 4,398,510 | 8/1983 | Custer | 123/90.16 |
| 4,399,787 | 8/1983 | Cavanagh | 123/321 |
| 4,423,712 | 1/1984 | Mayne et al. | 123/321 |
| 4,473,047 | 9/1984 | Jakuba et al. | 123/323 |
| 4,592,319 | 6/1986 | Meistrick | 123/321 |

*Primary Examiner*—William A. Cuchlinski, Jr.
*Attorney, Agent, or Firm*—Donald E. Degling

[57] ABSTRACT

An improved compression release retarder for internal combustion engines is disclosed. The improvement comprises hydro-mechanical mechanisms incorporated principally into the slave piston and adjustable stop which assures a prompt closing of the engine exhaust valve following a compression release event and provides means to advance the opening of the exhaust valve to begin the compression release event. The mechanism is automatic in that the exhaust valve opening advance mechanism alters the valve train lash to a predetermined level whenever the engine retarder is operated and the exhaust valve closing mechanism acts in response to the decrease in engine cylinder pressure during the compression release event.

5 Claims, 6 Drawing Figures

ENGINE RETARDER WITH RESET AUTO-LASH MECHANISM

BACKGROUND OF THE INVENTION

1. Field of the Invention

This invention relates to engine retarders of the compression release type. More particularly, the present invention relates to a mechanism which automatically modifies the valve train lash when the engine is placed in the retarding mode and simultaneously provides for a prompt reclosing of the exhaust valve following the compression release event.

2. The Prior Art

Engine retarders of the compression release type are well-known in the art. Such retarders are designed to convert, temporarily, an internal combustion engine of the spark ignition or compression ignition type into an air compressor so as to develop a retarding horsepower which may be a substantial portion of the operating horsepower normally developed by the engine.

The basic design for the engine retarding system of the type here involved is disclosed in the Cummins U.S. Pat. No. 3,220,392. In that design, an hydraulic system is employed wherein the motion of a master piston actuated by an appropriate intake, exhaust or fuel injector pushtube or rocker arm controls the motion of a slave piston which opens the exhaust valve of the internal combustion engine near the end of the compression stroke whereby the work done in compressing the intake air is not recovered during the expansion or "power" stroke but, instead, is dissipated through the exhaust and cooling systems of the engine.

Various improvements have been made in the original design shown in the Cummins U.S. Pat. No. 3,220,392. Laas U.S. Pat. No. 3,405,699 discloses a device which unloads the hydraulic system whenever excess motion of the slave piston tends to open the exhaust valve too far and hence risk damage to the components of the engine.

Egan U.S. Pat. No. 4,150,640 discloses a pressure relief valve in the high pressure hydraulic system which limits the maximum pressure attainable in that system. Sickler U.S. Pat. No. 4,271,796 discloses a pressure relief system for a compression release engine retarder wherein a bi-stable relief valve and a damping mechanism rapidly drops the pressure in the hydraulic system to a predetermined low level whenever an excess pressure is sensed in the hydraulic system, thereby obviating the risk of damage to various components of the engine valve train mechanism.

Johnson U.S. Pat. No. 4,384,558 discloses a mechanical mechanism incorporated into the slave piston and adapted to decrease the valve train lash during the retarding mode of operation. Custer U.S. Pat. No. 4,398,510 discloses an hydro-mechanical timing advance mechanism located in the slave piston adjusting screw which modifies the valve train lash during the retarding mode of engine operation.

Mayne et al. U.S. Pat. No. 4,423,712 discloses a spool valve located in the slave piston adjusting screw which cooperates with a reservoir located in the slave cylinder and unloads the slave piston at the end of the compression release event to insure prompt reclosing of the exhaust valve.

Cavanagh U.S. Pat. No. 4,399,787 discloses a mechanism which senses the force required to hold open an exhaust valve during a compression release event and releases the hydraulic pressure when this force has decreased substantially, thereby causing the exhaust valve to close.

Jakuba et al. U.S. Pat. No. 4,473,047 relates particularly to engines equipped with dual exhaust valves and an engine retarder of the compression release type and discloses apparatus adapted to open only one of the dual exhaust valves during the retarding mode of operation while permitting both valves to be opened during normal engine opera- tion.

As set forth in the patents referred to above, the compression release engine retarder utilizes portions of the existing engine valve train and fuel injection mechanism to open the exhaust valves near the end of the compression stroke. In order to avoid undesirable loading effects on the valve train mechanism, particularly when it is desired to open only one of a pair of dual exhaust valves during the compression release event, it is important to assure that the exhaust valves close promptly after the compression release event has been completed. However, it is also desirable to modify the lash in the valve train mechanism during retarding in order to improve the timing of the compression release event so as to maximize the retarding horsepower which can be developed by the engine.

SUMMARY OF THE INVENTION

In accordance with the present invention, applicants have provided an hydro-mechanical mechanism located in the slave piston and adjustable stop capable of simultaneously modifying the lash in the valve train mechanism and releasing the hydraulic pressure which actuates the slave piston whereby the exhaust valve opening motion is advanced and the closing motion is triggered when the engine cylinder pressure drops to a predetermined level. The mechanism incorporates passageways formed in the slave piston or its components to conduct high pressure hydraulic fluid to the low pressure portion of the circuit, spring biased valve means which control the flow of high pressure hydraulic fluid to the low pressure portion of the fluid circuit and piston and check valve means which automatically reposition the rest location of the slave piston during the retarding mode of operation.

BRIEF DESCRIPTION OF THE DRAWINGS

Additional advantages of the apparatus in accordance with the present invention will become apparent from the following detailed description of the invention and the accompanying drawings in which.

DETAILED DESCRIPTION OF THE INVENTION

As noted above, FIG. 1 is a schematic drawing of a compression release retarder for use in an internal combustion engine. The basic design for such a compression release retarder is disclosed in the Cummins U.S. Pat. No. 3,220,392 and there have been a number of improvements and modifications as outlined above. For purposes of simplicity and clarity the present invention will be described with reference to a compression ignition engine in which the master piston motion of the engine retarder is derived from the fuel injector cam. It will be understood that the invention may also be applied to the Cummins or other engines where, for example, the master piston motion is derived from a remote exhaust or intake valve cam.

Figure 1:
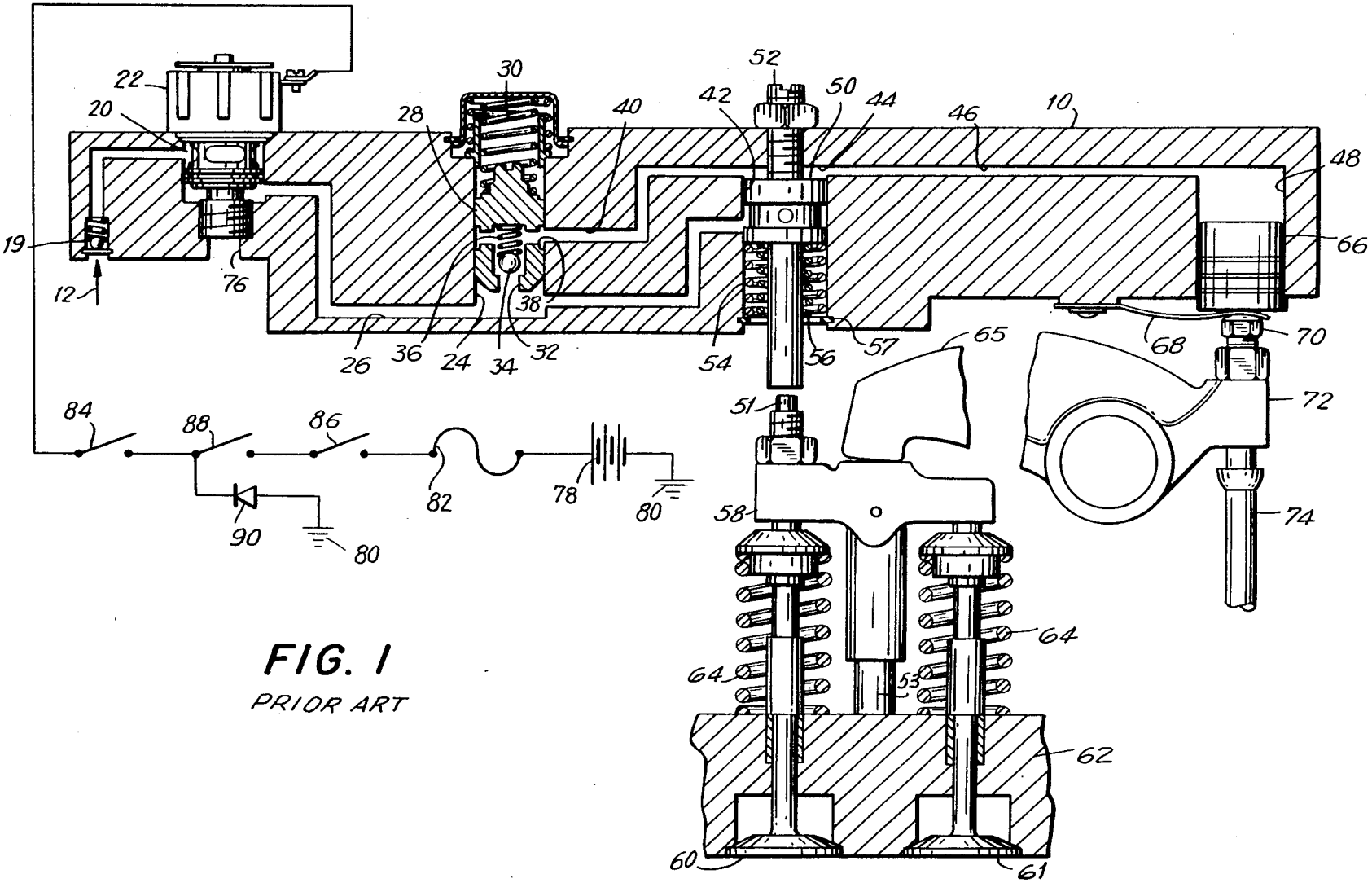
FIG. 1 PRIOR ART
FIG. 1 is a schematic drawing of a compression release engine retarder of conventional single valve opening design to which the present invention may be applied.

Referring now to FIG. 1, designator 10 represents a housing fitted on the internal combustion engine within which the components of the compression release engine retarder are contained. Oil 12 from a sump (not shown), which may be, for example, the engine crankcase, is pumped through a duct by a low pressure pump (not shown) through a check valve 19 to the inlet 20 of a two-position three-way solenoid valve 22 mounted in the housing 10. Low pressure oil is conducted from the solenoid valve 22 to a control cylinder 24 by a duct 26. A control valve 28, fitted for reciprocating movement within the control cylinder 24, is biased toward the closed position by a compression spring 30. The control valve 28 contains an inlet passage 32 closed by a ball check valve 34, which is biased toward the closed position by a compression spring 36, and an outlet passage 38. When the control valve 28 is in the open position (as shown in FIG. 1) the outlet passage 38 registers with the control cylinder outlet duct 40 which communicates with the inlet of a slave cylinder 42, also formed in the housing 10. It will be understood that low pressure oil 12 passing through the solenoid valve 22 enters the control valve cylinder 24 and raises the control valve 28 to the open position. Thereafter, the ball check valve 34 opens against the bias of spring 36 to permit the oil 12 to flow into the slave cylinder 42. From the outlet 44 of the slave cylinder 42 the oil 12 flows through a duct 46 into the master cylinder 48 formed in the housing 10.

A slave piston 50 is fitted for reciprocating motion within the slave cylinder 42. The slave piston 50 is biased in an upward direction (as shown in FIG. 1) against an adjustable stop 52 by a compression spring 54 which is mounted within the slave cylinder 42 and acts against a snap ring 56 fixed in a groove 57 formed in the slave cylinder 42. The lower end of the slave piston 50 acts against a pin 51 freely journalled within a crosshead 58 which, in turn, is fitted for reciprocating motion on a guide pin 53 seated in the engine cylinder head 62. The pin 51 engages the stem of exhaust valve 60 while the crosshead 58 engages the stems of both exhaust valve 60 and exhaust valve 61. Exhaust valve springs 64 normally bias the exhaust valves 60 and 61 to the closed position as shown in FIG. 1. It will be understood that in normal engine operation, rocker arm 65 acts downwardly on the crosshead 58 so as to open both exhaust valves 60 and 61. However, when the engine retarder is operating, the slave piston 50 acts through sliding pin 51 to open only exhaust valve 60. If it should be desired to open both exhaust valves 60 and 61 during retarding, the slave piston 50 may be aligned with the guide pin 53 so as to act directly on the crosshead 58. Normally, the adjustable stop 52 is set to provide a clearance of about 0.018 inch (i.e., "lash" ) between the slave piston 50 and the sliding pin 51 when the exhaust valve 60 is closed, the slave piston 50 is seated against the adjustable stop 52, and the engine is cold. This clearance is required and is normally sufficient to accommodate expansion of the parts comprising the exhaust valve train when the engine is hot without opening the exhaust valve 60.

A master piston 66 is fitted for reciprocating movement within the master cylinder 48 and biased in an upward direction (as viewed in FIG. 1) by a light leaf spring 68. The lower end of the master piston 66 contacts an adjusting screw mechanism 70 of a rocker arm 72 driven by a pushtube 74 from the engine camshaft (not shown). As noted above, when applied to the Cummins engine, the rocker arm 72 is conveniently the fuel injector rocker arm and the pushtube 74 is the fuel injector pushtube. In this circumstance, the pushtube 74 and the exhaust valve 60 are associated with the same engine cylinder.

It will be understood that when the solenoid valve 22 is opened, (i.e., energized), oil 12 will raise the control valve 28 and then fill both the slave cylinder 42 and the master cylinder 48. Reverse flow of oil out of the slave cylinder 42 and master cylinder 48 is prevented by the action of the ball check valve 34. However, once the system is filled with oil, upward movement of the pushtube 74 will drive the master piston 66 upwardly and the hydraulic pressure, in turn, will drive the slave piston 50 downwardly to open exhaust valve 60. The valve timing is selected so that the exhaust valve 60 is opened near the end of the compression stroke of the cylinder with which the exhaust valve 60 is associated. Thus, the work done by the engine piston in compressing air during the compression stroke is released to the exhaust and cooling systems of the engine and is not recovered during the expansion stroke of the engine.

When it is desired to deactivate the compression release retarder, the solenoid valve 22 is closed (i.e., deenergized) whereby the oil 12 in the control valve cylinder 24 passes through the duct 76 to the sump. The control valve 28 will then be urged downwardly by the spring 30 and a portion of the oil in the slave cylinder 42 and master cylinder 48 will be vented over the top of the control valve 28 and returned to the sump by duct means (not shown).

The electrical control system for the engine retarder includes the vehicle battery 78 which is grounded at 80. The hot terminal of the battery is connected, in series, to a fuse 82, a dash switch 84, a clutch switch 86, a fuel pump switch 88, the solenoid of the solenoid valve 22 and, preferably, through a diode 90 back to ground 80. The switches 84, 86, and 88 are provided to assure the safe operation of the system. Switch 84 is a manual control to deactivate the entire system. Switch 86 is an automatic switch connected to the clutch to deactivate the system whenever the clutch is disengaged so as to prevent engine stalling. Switch 88 is a second automatic switch connected to the fuel system to prevent engine fueling when the engine retarder is in operation.

Figure 2:
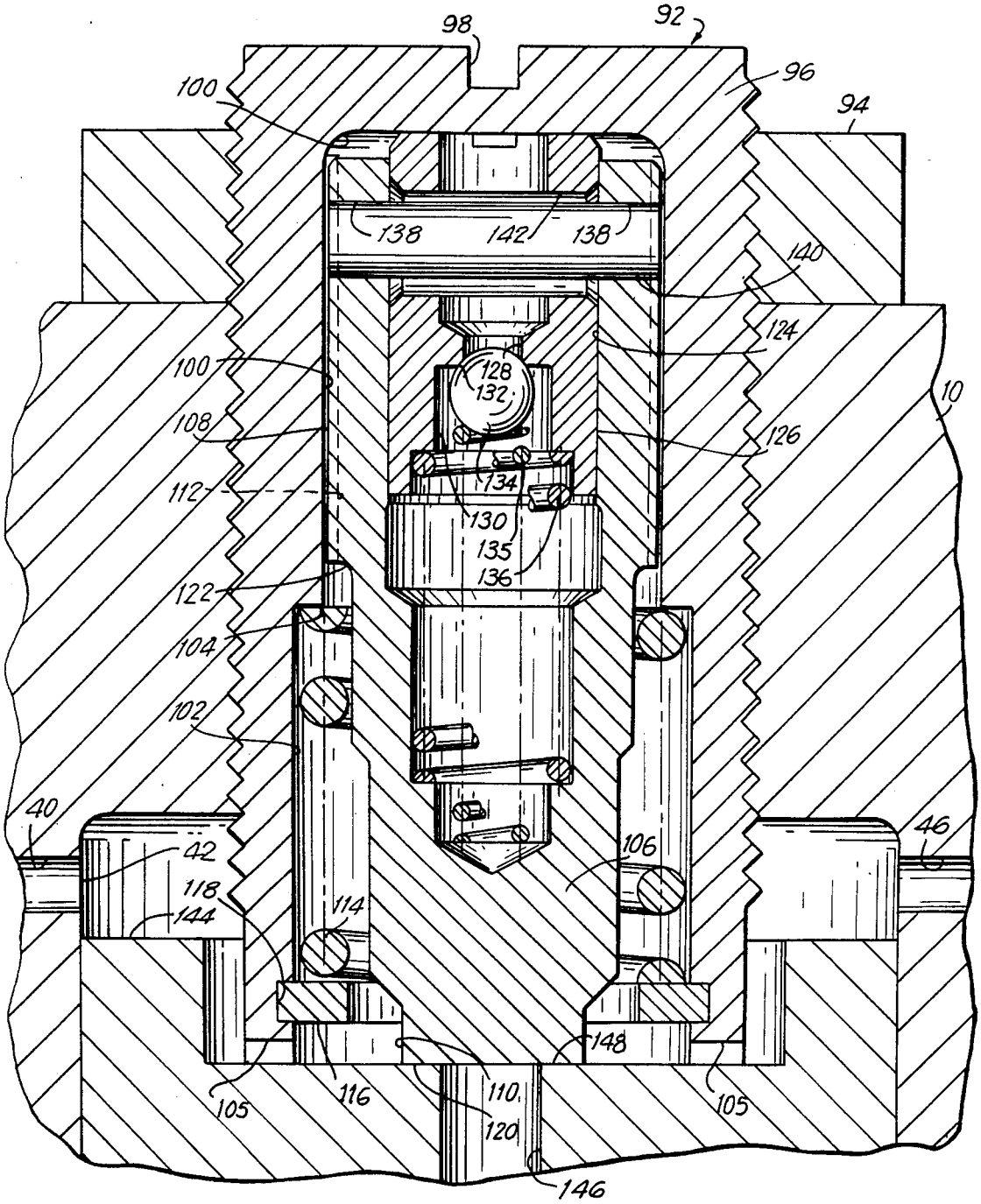
FIG. 2 is an enlarged fragmentary crosssectional view of a modified slave piston adjustable stop incorporating the mechanism of the present invention.

Reference is now made to FIG. 2 which illustrates a mechanism in accordance with the present invention incorporated principally in the adjustable stop 92 which is locked in its adjusted position in the housing 10 by a lock nut 94. The adjustable stop 92 comprises an exteriorly threaded body member 96 provided with a screwdriver slot 98 or equivalent adjusting means at its top or closed end. A first blind bore 100 is formed to extend substantially to the full depth of the body member 96 while an enlarged bore 102 extends to the midregion of the body member 96 so as to define a shoulder 104 between bores 100 and 102. Ports 105 are formed through the wall of the body member 96 to facilitate the flow of oil between the slave cylinder 42 and the bore 102.

Reset valve 106 is a generally cylindrical member having a maximum diameter 108 at one end which is slightly smaller than the diameter of the bore 100 and having a substantially smaller diameter 110 at its opposite end. The maximum diameter 108 of the reset valve 106 is sufficiently smaller than the diameter of the bore 100 to permit the flow of hydraulic fluid or oil past the reset value 106. If desired, one or more longitudinal or helical channels 112 may be formed on the outer surface of the reset valve 106 to facilitate the flow of oil past the reset valve. A compression spring 114 is seated in the bore 102 bearing against the shoulder 104 on one end and against a snap ring 116 at the opposite end. Snap ring 116 is seated in a groove 118 formed in the bore 102.

Reset valve 106 has a length somewhat less than the depth of the bore 100 in the body member 96 and a valve face 120 is machined on one end thereof normal to the axis of the reset valve. A shoulder 122 is formed at the end of the maximum diameter portion 108 of the reset valve 106 near the midpoint of the valve. As shown in FIG. 2, the shoulder 122 is positioned so as to clear the end of the spring 114 when the valve face 120 is aligned with the end of the body member 96. A blind bore 124 is formed in the end of the reset valve 106 opposite the valve face 120 and is sized to receive a piston member 126 therein. Piston member 126 has formed therethrough a first axial bore 128 and at least a second axial bore 130 formed partially therethrough so as to define a valve seat 132 at the junction of the bores 128 and 130. A ball valve 134 is located in the bore 130 and is biased toward the valve seat 132 by a compression spring 135, the opposite end of which is seated in the blind end of the blind bore 124. Piston member 126 is biased in an upward direction (as viewed in FIG. 2) by a compression spring 136, the opposite end of which is seated in the blind end of the blind bore 124.

Holes 138 are bored on a diameter of the reset valve 106 near the end thereof which is opposite the valve face 120 to receive, with a press fit, pin 140. A mating diametral slot 142 is formed in the piston member 126. The diametral slot 142 has a dimension in the axial direction which is greater than the diameter of the pin 140 so as to permit limited axial movement of the piston member 126 with respect to the reset valve 106.

As pointed out above, the normal clearance or "lash" in the valve train mechanism is on the order of 0.018 inch when the slave piston 50 is seated against the adjustable stop 52. In FIG. 2 the slave piston 144 normally seats against the end of the body member 96. It will be appreciated that the axial dimension of the diametral slot 142 determines the maximum extension of the valve face 120 beyond the end of the body member 96 when the piston 126 is fully extended from the valve 106. By increasing the axial dimension of the diametral slot 142 the valve train clearance or "lash" can be reduced to any desired amount or even made negative. A negative clearance or "lash" implies that, during retarding, the exhaust valves will be maintained at least partially open.

Slave piston 144 is provided with an axial passageway 146 which leads to a low pressure region such as the engine sump or the control valve cylinder 24. Slave piston 144 is also provided with a machined surface 148 which serves as a valve seat for valve face 120 and as an abutting surface for the body 96 of the adjustable stop 92.

The operation of the mechanism is as follows: When the solenoid valve 22 is energized, low pressure oil 12 flows into the slave cylinder 42, into the bore 102 of the body member 96, past the reset valve 106 in the bore 100 and into the bore 128 of the piston member 126. The low pressure oil 12 also flows past the ball check valve 134 to fill the bore 130. As pressure builds up in the slave cylinder 42 due to motion of the master piston 66, the slave piston 144 will be driven downwardly, thereby opening the exhaust valve 60. Reset valve 106 remains seated against slave piston 144 due to the pressure in bore 100. However, piston member 126 will be driven upwardly (as viewed in FIGS. 2 and 3A) relative to the reset valve 106 due to the bias of compression spring 136, the hydraulic pressure in bores 128 and 130 being substantially equal.

Figure 3B:
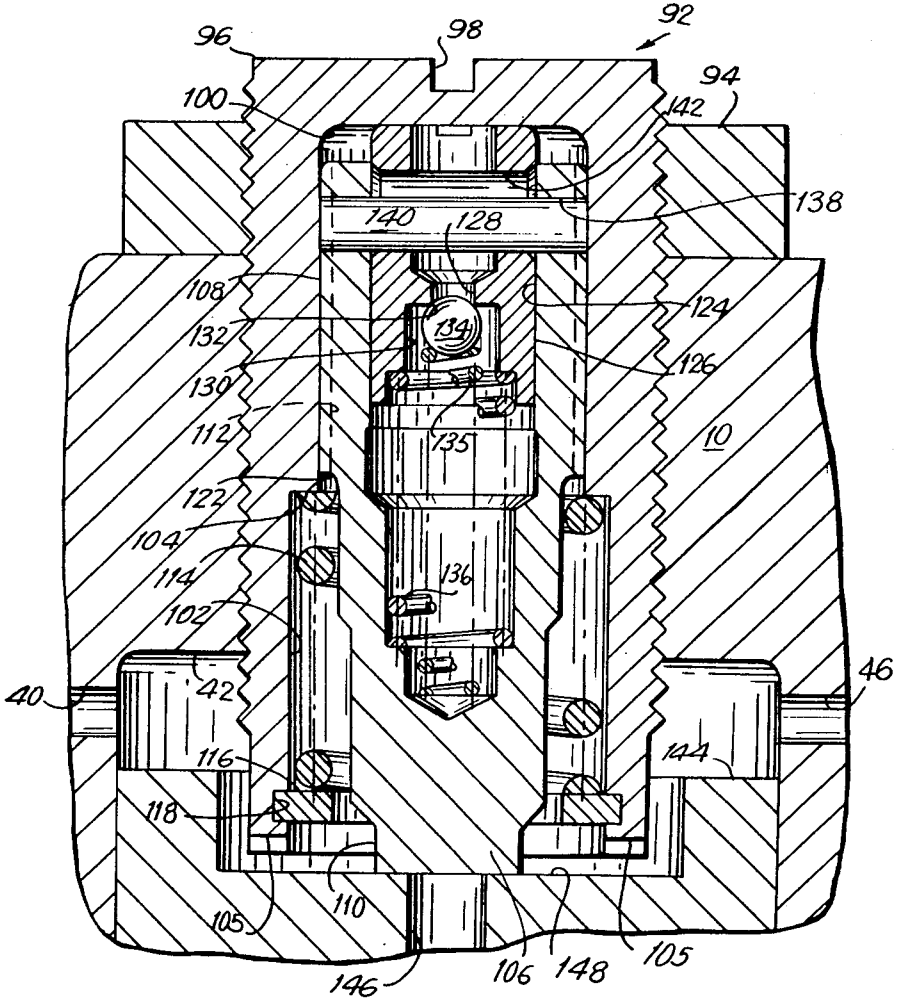
FIG. 3B is a cross-sectional view of the modified slave piston adjustable stop of FIG. 2 following the compression release event and resetting function in preparation for the ensuing compression release event.
Figure 3A:
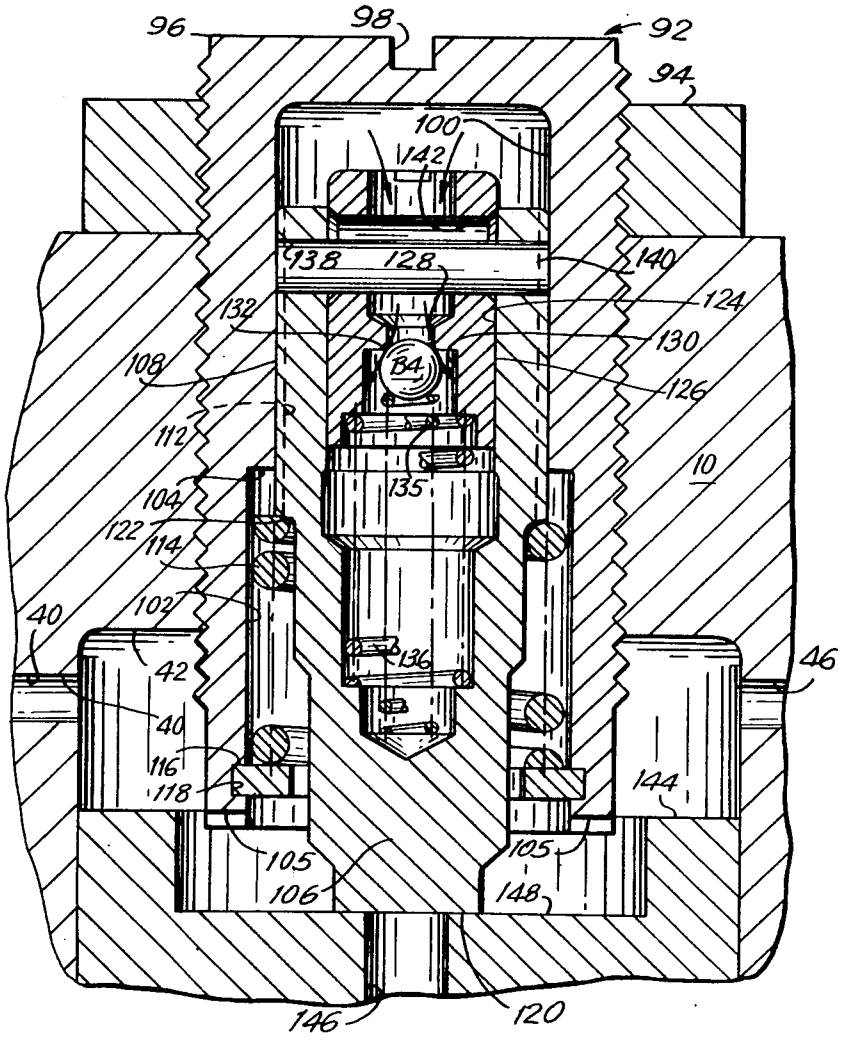
FIG. 3A is a cross-sectional view of the modified slave piston adjustable stop of FIG. 2 during a compression release event but prior to the resetting function.

Eventually, the downward motion of the reset valve 106 will cause the shoulder 122 to contact compression spring 114 and begin to compress spring 114, thereby applying an upward force on the reset valve 106. As the engine cylinder pressure drops due to the opening of the exhaust valve 60 and the downward motion of the engine piston, the net hydraulic force which maintains the reset valve 106 in contact with the slave piston 144 also decreases while the separating force due to the bias of compression spring 114 increases. When the separating force exceeds the net hydraulic force, the reset valve 106 will separate from the slave piston 144 and hydraulic fluid will be vented through passageway 146. At this point, the reset valve 106 will be driven upwardly by the compression spring 114 until the end of the piston member 126 strikes the blind end of the bore 100 in the body member 96. Due to the action of the ball check valve 134, high pressure hydraulic fluid will be trapped, temporarily, in the bore 130 of the piston member 126 so that the piston member 126 will remain in its extended position as shown in FIG. 3B. Thereafter, the upward bias of the exhaust valve spring 64 will drive the slave piston 144 in an upward direction until it seals against the valve face 120, thereby terminating the flow of hydraulic fluid through passageway 146.

It will be appreciated that in the new rest position of the slave piston 144 the desired decreased clearance or "lash" in the valve train for the retarding mode has been attained. Moreover, the slave piston 144 is at a rest position and the exhaust valve 60 has closed even though the master piston 66 may not have retracted. The slave piston 144 is thus ready for the next retarding cycle but separated from the exhaust valve train mechanism so as not to affect the normal operation of that mechanism.

At the end of the retarding mode of operation the hydraulic pressure in the slave cylinder 42 will be vented so as to create a pressure differential between the hydraulic fluid trapped in the bore 130 of the piston member 126 and the hydraulic fluid in bores 100 and 102 of the body member 96. An appropriate clearance is provided between the piston member 126 and the blind bore 124 to bleed off the pressure trapped behind piston 126 in the blind bore 124 within a few engine cycles. It will be understood that the slave piston compression spring 54 will maintain an upward bias on the reset valve 106 through the slave piston 144 until the slave piston seats against the end of the body member 96 so as to restore the operating clearance or "lash" to the system.

Figure 4:
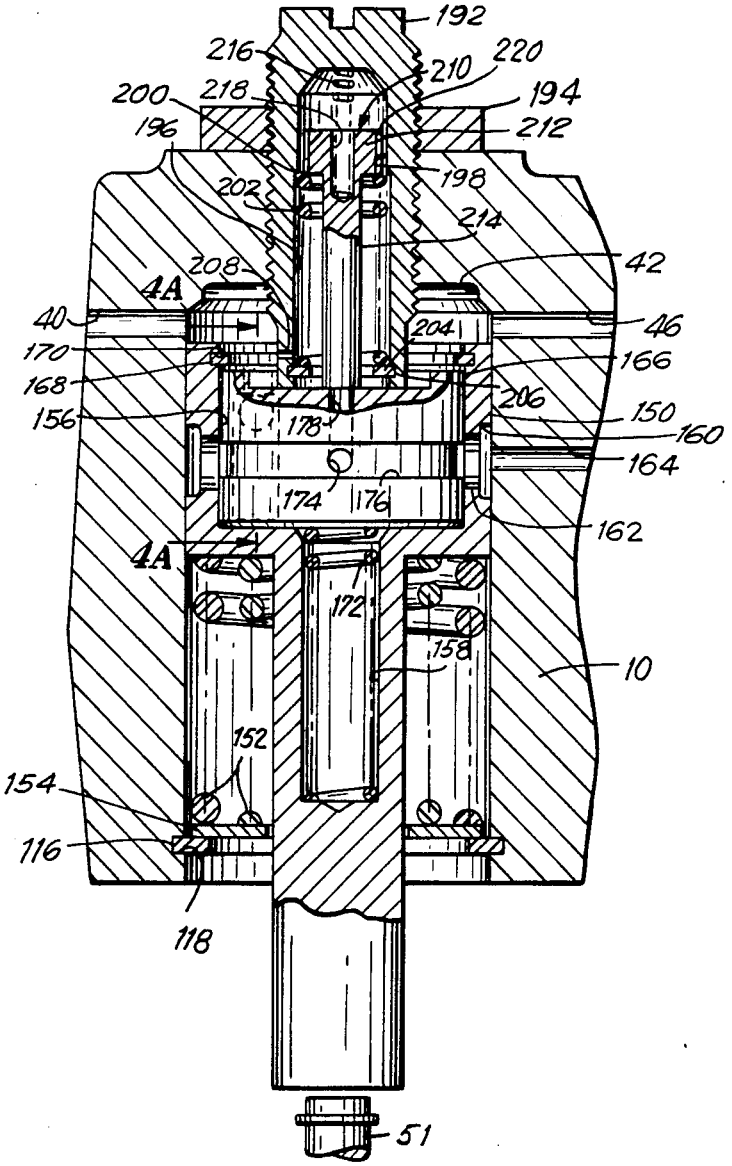
FIG. 4 is an enlarged cross-sectional view of an alternative modified slave piston and slave piston adjustable stop incorporating mechanism in accordance with the present invention.
Figure 4A:
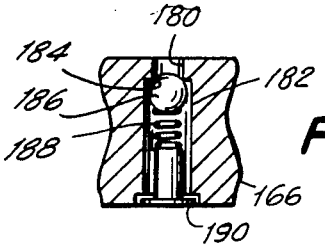
FIG. 4A is a fragmentary cross-sectional view taken along line 4A—4A of FIG. 4 showing the check valve incorporated in the slave piston mechanism.

Reference is now made to FIGS. 4 and 4A which illustrate an alternative mechanism incorporating the present invention. Slave cylinder 42 is located in the housing 10 and communicates with the control cylinder 24 (FIG. 1) through duct 40 and with the master cylinder 48 (FIG. 1) through duct 46. Slave piston 150 is mounted for reciprocating motion in slave cylinder 42 and biased in an upward direction (as viewed in FIG. 4) by compression springs 152 which act against a retaining washer 154 which, in turn, is secured within the slave cylinder 42 by a snap ring 116 seated in a groove 118 formed in the slave cylinder 42.

Formed in the slave piston 150 is a first axial bore 156 and second axial bore 158 which is of smaller diameter but greater depth than the first bore 156. An annular channel 160 is formed around the circumference of the slave piston 150 opposite the first axial bore 156. The annular channel 160 communicates with the first axial bore 156 through a plurality of ports 162 and registers with duct 164 formed in the housing 10. Duct 164 communicates with a low pressure region of the hydraulic fluid circuit such as the control cylinder 24 or the engine sump.

Timing advance piston 166 is mounted for limited reciprocating motion in the first axial bore 156 of slave piston 150. Upward motion of the timing advance piston 166 is limited by snap ring 168 which is seated in a groove 170 formed in the first axial bore 156 of the slave piston 150. The timing advance piston 166 is biased toward the snap ring 168 by a compression spring 172 seated in the second axial bore 158 of the slave piston 150. A diametral bore 174 formed through the timing advance piston 166 generally adjacent to ports 162 communicates with ports 162 through an annular channel 176 formed on the circumference of the timing advance piston 166. An axial bore 178 communicates between the top of the timing advance piston 166 and the diametral bore 174. As is most clearly shown in FIG. 4A, a first eccentric bore 180 is formed through the timing advance piston 166 coaxially with a second larger bore 182 so as to define a check valve seat 184. Ball valve 186 is biased toward valve seat 184 by a compression spring 188 which is confined in the bore 182 by an eyelet 190 press fitted into bore 182.

Adjustable stop 192 is threaded into the housing 10 and locked in its adjusted position by lock nut 194. A first axial bore 196 extends to the midregion of the adjustable stop 192 while a second smaller coaxial blind bore 198 extends deeper into the adjustable stop so as to define a shoulder 200 therebetween. A compression spring 202 is lightly biased against the shoulder 200 by a snap ring 204 carried in a groove 206 formed in the first bore 196 of the adjustable stop 192. A plurality of ports 208 are formed through the wall of the adjustable stop 192 adjacent the groove 206 so as to communicate between the slave cylinder 42 and the first axial bore 196.

A reset valve 210 having an enlarged head 212 and an elongated body 214 is positioned so that its head 212 lies substantially in the second coaxial bore 198 while its elongated body 214 lies substantially in the first axial bore 196 of the adjustable stop 192. Reset valve 210 is biased toward the timing advance piston 166 by a light compression spring 216 one end of which bears against the end of blind bore 198 while the other end is seated in a blind bore 218 formed axially through the head 212 of the reset valve 210. When the end of the elongated body 214 of the reset valve 210 contacts the timing advance piston 166, it seals the axial bore 178 so as to prevent the flow of hydraulic fluid therethrough. The head 212 of the reset valve 210 is sized to engage the compression spring 202 when the reset valve 210 moves downwardly and the head 212 enters the first axial bore 196, but sufficient clearance is provided to permit the passage of hydraulic fluid from the first bore 196 to the second bore 198 of the adjustable stop 192. If desired, one or more lateral channels 220 may be formed along the surface of the head 212 to facilitate fluid flow between bores 196 and 198.

The operation of the mechanism is as follows: During normal engine operation the slave cylinder 42 is vented through duct 40 and the control cylinder 24. Compression springs 152 bias the slave piston 150 toward the adjustable stop 192 and seat the timing advance piston 166 at the blind end of the bore 156. Reset valve 210 seals the axial bore 178 in the timing advance piston and the head 212 of the reset valve 210 is located in bore 198 out of engagement with compression spring 202. Under these conditions, the slave piston 150 is spaced from the sliding pin 51 by a distance representing the normal operating clearance in the valve train, e.g., 0.018 inch. When the retarder is turned on, oil 12 flows into the slave cylinder 42 and through the ball check valve 184 into the bore 156 of the slave piston. As the pressure in the slave cylinder 42 rises, the slave piston 150 is driven against the pin 51 so as to take up the clearance and the timing advance piston 166 is driven upwardly toward the snap ring 168.

When the hydraulic pressure in the slave cylinder 42 becomes high enough to overcome the bias of compression springs 152, exhaust valve spring 64 and the engine cylinder pressure, the slave piston 150 will move downwardly (as viewed in FIG. 4) and open the exhaust valve 60 (FIG. 1). Reset valve 210 follows the downward motion of the slave piston 150 and timing advance piston 166 due to the hydraulic pressure and the bias of spring 216. During the downward motion of the reset valve 210, the head 212 engages the compression spring 202 which exerts an upward bias on the reset valve 210. When the exhaust valve 60 has begun to open, the engine cylinder pressure drops and this is reflected in the slave cylinder pressure thereby decreasing the downward force on the reset valve 210. When the downward forces in the reset valve 210 fall below the upward bias of spring 202, the reset valve 210 separates from the timing advance piston 166 and the hydraulic pressure in slave cylinder 42 is vented through bores 178 and 174, channel 176, ports 162, channel 160 and duct 164 to a low pressure region of the hydraulic circuit. The slave piston 150 will then be driven upwardly by the bias of the exhaust valve spring 64 (FIG. 1) and slave piston springs 152 until the timing advance piston 166 strikes the end of the adjustable stop 192. However, the timing advance piston 166 will remain in contact with the snap ring 168 since high pressure hydraulic fluid will be trapped in the bores 156 and 158 of the slave piston 150 behind the check valve 186. Thus, at the end of one engine cycle, the slave piston 150 will be displaced downwardly a distance equal to the travel of the timing advance piston 166 within bore 156 of the slave piston.

It will be understood that the travel of the timing advance piston 166 can be varied so as to decrease the valve train lash to zero or even provide a negative lash. So long as the retarder is operating, the timing advance piston 166 will be forced against the snap ring 168 and leakage of hydraulic fluid past the piston 166 will be replaced by periodic flow through the check valve 186. However, when the retarder is turned off, the pressure differential between bores 156 and 158 and the slave cylinder 42, aided by the bias of springs 152, will cause the piston 166 to seat against the bottom of bore 156 within a few engine cycles as a result of leakage. Thus, the original valve train clearance will be restored.

It will be seen that in the mechanism incorporating the present invention the designer can control the degree of timing advance by determining the travel of the piston member 126 (FIGS. 2, 3A and 3B) or the timing advance piston 166 (FIG. 4) and can control the point at which the slave piston begins to reset by determining the installed force and spring rate of spring 114 (FIGS. 2, 3A and 3B) or spring 202 (FIG. 4). As these elements are located principally in the adjustable stop and slave piston portions of the retarder mechanism, it is possible to apply the present invention to existing retarders, except for the feature of venting fluid from the slave cylinder to the control cylinder 74. However, most of the retarders to which the present invention is applicable have an oil supply system which is adequate to permit venting a portion of this oil through the slave piston. This may be accomplished by extending passageway 146 through the slave piston 144 (FIGS. 2, 3A and 3B) or providing exterior longitudinal channels on the slave piston 150 from the annular channel 160 to the lower edge of the skirt of the slave piston 150 (FIG. 4).

The terms and expressions which have been employed are used as terms of description and not of limitation and there is no intention in the use of such terms and expressions of excluding any equivalents of the features shown and described or portions thereof, but it is recognized that various modifications are possible within the scope of the invention claimed.

What is claimed is:

1. In an engine retarding system of a gas compression release type including an internal combustion engine having exhaust valve means and pushtube means, hydraulic pressure supply means, hydraulically actuated first piston means having high and low pressure sides associated with said exhaust valve means to open said exhaust valve means at a predetermined time and movable between first and second positions, second piston means actuated by said pushtube means and hydraulically interconnected with said first piston means, and adjustable stop means disposed in abutment with said first piston means when said first piston means is in its said first position, the improvement comprising fluid passageway means formed through said first piston means between said high and said low pressure sides thereof, reset valve means positioned substantially within said adjustable stop means for reciprocating motion therewith, said reset valve means having a valve face formed on one end thereof and adapted to seat against said high pressure side of said first piston means thereby sealing said fluid passageway means, first biasing means adapted to bias said reset valve means toward said first piston means, second biasing means adapted to bias said reset valve means away from said first piston means when said first piston means approaches its said second position, third piston means mounted within said reset valve means for reciprocating motion therewith and movable between first and second positions, said first biasing means also adapted to bias said third piston means toward said second position of said third piston means, said third piston means having passageway means formed therethrough, and check valve means located in said passageway means of said third piston means and adapted to hydraulically lock said third piston means in said second position.

2. An engine retarding system as described in claim 1 wherein said third piston in its second position extends outwardly a predetermined distance from the end of said reset valve which is opposite the end of said valve having formed thereon said valve face.

3. An engine retarding system as described in claim 2 in which the clearance between said third piston means and said reset valve means is sufficient to bleed down said high pressure to said low pressure within a few engine cycles whenever said hydraulic pressure supply means is turned off.

4. In an engine retarding system of a gas compression release type including an internal combustion engine having exhaust valve means and pushtube means, hydraulic pressure supply means, hydraulically actuated first piston means having high and low pressure sides associated with said exhaust valve means to open said exhaust valve means at a predetermined time and movable between first and second positions, second piston means actuated by said pushtube means and hydraulically interconnected with said first piston means, and adjustable stop means, the improvement comprising third piston means mounted for reciprocating motion within said first piston means on the high pressure side thereof, said third piston means movable between first and second positions and having first and second fluid passageway means formed therein, fluid passageway means formed through said first piston means between said high and said low pressure sides thereof and communicating on the said high pressure side with said first fluid passageway means formed in said third piston, reset valve means positioned substantially within said adjustable stop means for reciprocating motion therewith, said reset valve means having a valve face formed on one end thereof and adapted to seat against one end of said third piston means thereby sealing said first fluid passageway means, first biasing means adapted to bias said reset valve means toward said third piston means, second biasing means adapted to bias said reset valve means away from said third piston means when said first piston means approaches its said second position, third biasing means adapted to bias said third piston means toward said second position of said third piston means, and check valve means located in said second fluid passageway means of said third piston means and adapted to hydraulically lock said third piston means in said second position.

5. An engine retarding system as described in claim 4 in which the clearance between said third piston means and said first piston means is sufficient to bleed down said high pressure to said low pressure within a few engine cycles whenever said hydraulic pressure supply means is turned off.

* * * * *